United States Patent [19]

Van Kanegan et al.

[11] Patent Number: 4,864,925

[45] Date of Patent: Sep. 12, 1989

[54] SIMPLIFIED LITHOGRAPHY USING INK AND WATER ADMIXTURES

[75] Inventors: Eugene M. Van Kanegan, Elmhurst; Frank J. Doyle, Downers' Grove; Thomas A. Fadner, La Grange, all of Ill.

[73] Assignee: Rockwell International Corporation, Pittsburgh, Pa.

[21] Appl. No.: 101,911

[22] Filed: Sep. 28, 1987

[51] Int. Cl.[4] ..... B41F 7/26; B41F 7/32; B41F 31/04; B41F 31/06

[52] U.S. Cl. ..... 101/141; 101/148; 101/451; 101/350; 101/366

[58] Field of Search ..... 101/450.1, 451, 452, 101/148, 141, 350, 366

[56] References Cited

U.S. PATENT DOCUMENTS

| | | | |
|---|---|---|---|
| 3,557,817 | 1/1971 | Royse | 101/148 |
| 3,947,356 | 3/1976 | Werhli | 101/147 |
| 4,088,074 | 5/1978 | Dahlgren et al. | 101/148 |
| 4,523,854 | 1/1985 | Beckley | 101/147 |
| 4,527,479 | 7/1985 | Dahlgren-Taylor | 101/148 |
| 4,690,055 | 9/1987 | Fadner | 101/148 |
| 4,722,274 | 2/1988 | Jeschke | 101/148 |

FOREIGN PATENT DOCUMENTS

| | | | |
|---|---|---|---|
| 47506 | 3/1982 | European Pat. Off. | 101/142 |
| 8001151 | 6/1980 | PCT Int'l Appl. | 101/147 |
| 2142448 | 1/1985 | United Kingdom | 101/DIG. 24 |

*Primary Examiner*—Clifford D. Crowder

[57] ABSTRACT

A system for the continuous and automatic supply of a mixture of ink and dampening fluid to a lithographic press. The ink and dampening fluid are mixed and then pumped to the press fountain. The fluid mixture is sampled downstream from the mixing location and a signal is sent to control feed of ink and dampening fluid to the mixing location to ensure that the desired ratio of ink to water is maintained.

6 Claims, 3 Drawing Sheets

SIMPLIFIED LITHOGRAPHY USING INK AND WATER ADMIXTURES

BACKGROUND OF THE INVENTION

In the art and practice of high-speed lithographic offset printing, ink is more-or-less continuously conveyed from a suitable reservoir by means of a series of coextensive rollers to a planographic printing plate where the image portions of the printing plate accept ink from the last of the series of inking rollers then transfer a portion of that ink to a printing blanket as a reverse image from which a portion of the ink is transferred in the form of a right-reading image to paper or another suitable substrate. It is essential in conventional lithographic printing processes that dampening water containing proprietary additives also be conveyed more-or-less continuously to the printing plate where by transferring in part to the non-image areas of the printing plate the water operates to keep those non-image areas free of ink.

In practical printing press system, both the ink and the dampening water are continuously available to all parts of the printing plate, image and non-image areas alike; and in the absence of dampening water, the printing plate will accept ink in both the image and non-image areas of its surface.

Lithographic printing plate surfaces in the absence of imaging materials have minute interstices and an overall hydrophilic or water-loving character that enhance retention of water rather than ink in the non-imaged areas. Imaging this hydrophilic plate surface creates oleophilic areas according to the desired image format. Subsequently, when water is presented to the inked, imaged plate in appropriate amounts only that ink residing in non-image areas becomes debonded. In its simplest view, this action accounts for the continuous ink and water differentiation at the printing plate surface which differentiation is essential and integral to the lithographic printing process.

Controlling for the correct amount of dampening water input during lithographic printing has been an industry-wide problem ever since the advent of lithography. Doing so requires continual operator attention since each change in ink input appears to require a change in dampener input. However, balancing the ink input across the width of the press with dampener input across the width of the press is at best a compromise. Consequently, depending upon which portion of the image format the operator has selected for complying to a standard print quality at any given time during the printing run, he may need to adjust the ink input at that cross-press position which inadvertently also changes the water balance at that position. Conversely, the operator may adjust the dampener input to balance one portion of the image which action may affect the ink and water balance at one or more other cross-press locations. Adjustments of these types tend to occur repeatedly throughout the whole press run resulting in slight to major differences in the quality of the printed output throughout the run. In carrying out these adjustment operations, the resulting copies may or may not be commercially acceptable, leading to waste in manpower, materials, and printing machine time.

Means for correcting this inherent fault of conventional lithography have been addressed; none have achieved industry-wide success. Certain of these methods involve eliminating the dampening system, others involve eliminating operator control of the dampening system.

Certain very successful newspaper printing configurations rely on the inking train rollers to carry dampening water to the printing plate. Notable among these are the Goss Metro, Goss Metroliner, and Goss Headliner Offset products manufactured by the Graphic Systems Division of Rockwell International Corporation. Reasons why the ink-train-dampening system operates especially-well without necessity for alcohol or similar dampener additives as traditionally specified for use with other existing ink-train-dampeners are not clear. Importance to the background of the instant invention is demonstrated by the fact that configurations such as those noted above will, together with appropriate ink and dampening concentrate selections, function such that the ink itself carries all of the required dampening water to the printing plate, yet the press functions and is controlled more-or-less conventionally from the viewpoint of lithographic printing. Accordingly, all of the conventional problems inherent in attaining and maintaining the optimum balance of ink and water input also attend this type of ink-train-dampening lithographic printing press system.

REFERENCES TO RELATED PRIOR ART

Planographic printing systems and elements thereof which do not require dampening water, and may therefore be termed single-fluid systems, were disclosed by Gipe in U.S. Pat. No. 3,677,178 and by Curtin in U.S. Pat. No. 3,511,178. More recently Toray Industries of Japan has marketed a printing plate referred to as the Toray Waterless Plate. These systems rely in one way or another on low-surface-energy silicone non-image portions of the printing plate disallowing ink adhesion, thereby forming the basis for differentiation between ink-receptive nonsilicone image areas and of non-ink-receptive non-image silicone areas of the printing plate. Only ink needs to be available to the plate, dampening solutions being unnecessary. These single-fluid planographic printing systems enjoy limited commercial success because of higher plate cost and because the more-expensive printing plates have a relatively short useful lifetime on-press. In addition, the ink needs to be formulated to take into account that the press temperature varies during printing causing the ink transfer efficiency to change, necessitating more-or-less continual operator adjustment of inking keys. Thus, although no dampening fluid adjustments are necessary, cooling of press cylinders may be required and/or considerable operator attention to compensate for gradual heat-induced inking changes render these systems of limited commercial value. For these reasons usefulness of these systems has in practice been limited to short runs, generally of 50,000 copies or less.

Warner in U.S. Pat. No. 4,287,827 describes a printing press system using an inking roller that is manufactured to have bimetal surfaces for instance chromium and copper, which different roller surfaces are claimed to simultaneously carry dampening solution and ink, respectively, to the form rollers of a simplified inking system. Warner, thereby, avoids the necessity for an independent dampening system of rollers. The Warner technology specifies planarity of the roller surface which is a distinct departure from the instant invention. In the Warner technology, the ink-loving copper areas will carry an ink quantity corresponding to the thickness of the ink film being conveyed to it by preceding rollers in the inking system. Thus the primary metering of the ink is done separately from the bimetallic surfaces of the roller or through the use of a flooded nip between the bimetal roller and a coacting resiliently-covered inking roller. This contrasts completely with the instant technology, which utilizes a celled oleophilic, hydrophobic metering roller together with a doctor blade to define the amount of water-containing ink being continuously conveyed to the form rollers. In addition, the instant invention involves using an already-mixed ink and water system, rather than relying on hydrophilic land areas of the inking rollers, as in the Warner technology, to supply dampening solution to the printing plate.

In an extension of the aforementioned Warner technology, Moll in U.S. Pat. No. 4,619,198, described an improvement thereupon by separately and controllably introducing dampening water and ink to the keyless inking system that is based on the planographic bimetal-surfaced meter roller of the Warner technology. This is a distinct departure from the admixture approach of this invention. Moll correctly introduces a scraping or doctor blade for removal of unused return ink, a feature that Warner had not employed. However, Moll merely discards this scraped-off ink in order to retain control of the incoming ink, purposefully avoiding its return to the inker system. Although the Moll features render the Warner technology more useful as a keyless printing system, it does not lend itself to operation as a closed, self-contained system and departs significantly from the elements as herein disclosed that are necessary to do so.

A number of celled or recessed or anilox-type ink metering rollers have been described in trade and technical literature. The American Newspaper Publishers Association (ANPA) has described in Matalia and Navi U.S. Pat. No. 4,407,196 a simplified inking system originally designed for letterpress printing which uses chromium or hardened steel or hard ceramic materials like tungsten carbide and aluminum oxide as the metering roller material of construction. These hard materials are advantageously used to minimize roller wear in a celled ink-metering roller inking system operating with a continuously scraping coextensive doctoring blade. Letterpress printing is a single fluid system and does not require purposeful and continuous addition of water to the printing system for image differentiation and, therefore, debonding of ink by water from these inherently hydrophilic rollers does not occur and continuous ink metering control is possible. Attempts have been made to adopt the ANPA system to lithographic printing without benefit of the instant technology. The ANPA technology rollers are naturally both oleophilic and hydrophilic and will sooner or later fail by water debonding the ink from the metering roller. The failure will be particularly evident at high printing speeds or high dampener settings where buildup of water occurs more rapidly and for combinations of image formats and ink formulations that have high water demand. The instant technology avoids these sensitivities. Further, instant technology specifies means for mixedly erasing cross-press, ink/mixing balance differences by means of an ink circulation system, a distinct and important departure from, the Matalia and Navi technology.

In a copending U.S. patent application Ser. No. 4,690,055, Fadner et al have described two-fluid keyless inking that avoids the aforementioned prior art shortcomings when used with conventionally-dampened press systems. That application discloses the following: a scraped, oleophilic and hydrophobic celled metering roller operating against one or more form rollers and with a pressure-related, resilient ink-input or pan roller configured as a keyless lithographic printing press couple, a dampening system of rollers to apply dampening fluid directly to the printing plate or alternately to one of the inking rollers, means for conveying scraped ink to a circulation/mixing system, an ink circulation/mixing system wherein the inherent cross-press ink/water ratio differences are erased, and consisting of an ink pan/reservoir, pipes, pumps, and appropriate conduits, an ink-pan level controlling system, an ink pan/reservoir of such volume and design that it assures the ink being fed to the metering roller is uniform in water-content composition at any given instant of time despite existence of the continual water ratio differences of the scraped ink previously referred to, said ink circulation system designed to continuosly collect and distribute the ink/water mix from the reservoir through a plenum or series of orifices directed to uniformly redistribute the ink/water mix across the press width thereby assuring instantaneously-uniform water content in the ink that is being introduced to the metering roller, and including said wear-resistant, hydrophobic and oleophilic, ink metering roller plus a coextensive scraper-blade, said roller defined by any of U.S. Pat. Nos. 4,537,127, 4,567,827 or 4,601,242.

All of these Fadner et al elements are necessary and advantageous in two-fluid keyless lithographic inking systems of the scraped, celled metering roller type, to assure that temporarily-large quantities of water present at the printing plate or in the roller/pan inking system do not accumulate anywhere in the system to interfere with ink conveyance or transfer.

None of the prior art disclosures allow successful elimination of operator-interfaced adjustment of the optimal printing fluid or fluids without detracting from the excellent high speed, long run, high quality operating attributes characteristic of the conventional two-fluid lithographic printing process. Keyless inking, as disclosed by Fadner et al, allows eliminating inking keys and the corresponding continual adjustment which greatly simplifies the lithographic printing process. It does not provide means for eliminating the separate dampening water input system and its corresponding need for operator attention. And the Toray type single-fluid systems eliminate the need for a dampening system but do not obviate necessity for continual adjustment of inking input by the operator.

The prior art Warner technology eliminates need for a conventional dampening system as well as need for inking keys. However, without use of a scraping blade or alternative means for removing and reconstituting the return ink and water mixture, lacks the control necessary for printing under widely varying printing conditions.

The Moll technology allows lithographic printing without inking keys and with a minimal attention to dampening water input control. However, Moll disallows reuse of the scraped ink and water mix, the water content of which differs significantly from the relative values of the input ink and water. Discarding rather than reconstituting these large quantities of ink is economically impractical in most printing operations.

We have found that employing the principles of keyless inking, essentially as disclosed in U.S. Pat. Nos. 4,603,634 4,567,827 4,537,127, 4,601,242 and in pending U.S. Pat. application Ser. No. 4,690,055, together with the use of an ink containing the required dampening water essentially as a single fluid circumvents the prior art shortcomings, yet enables operating a printing press manufactured according to the principles described herein without necessity for a separate dampening water input system.

OBJECTS OF THE INVENTION

A primary object of this invention is to provide a simplified lithographic printing system having fewer operator-interfaced materials controls than in prior art lithography and planography.

Another primary object of this invention is to provide means for printing lithographically without the necessity for a separate dampening system.

A further object of this invention is to provide means for conveying ink that contains dampening water substantially as a single fluid to a substantially conventional lithographic printing plate in sufficient quantities to provide image differentiation of the ink and of the water at the printing plate.

Still another object is to provide means for continuously replenishing into the ink the dampening water that is used up for image differentiation at the printing plate.

Yet another object is to provide automatic control of the lithographic ink and water contents through the use of suitable sensors and water-replenishment means.

These and other objects will become apparent by referring to the accompanying drawings and disclosures, in which:

DESCRIPTION OF THE INVENTION

Figure 1:
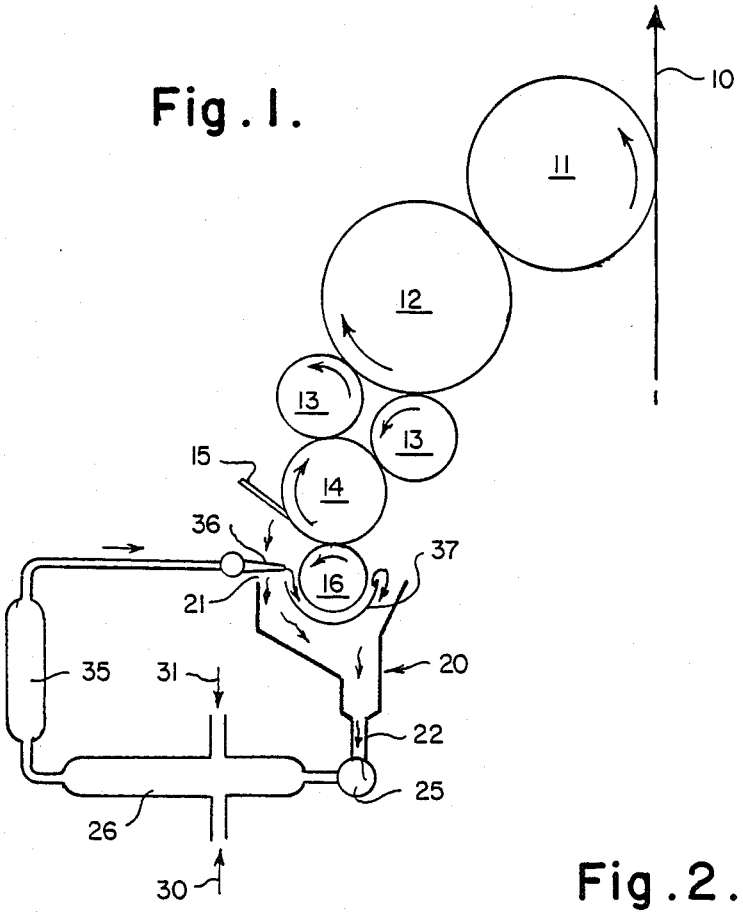
FIG. 1 is a schematic showing the inking system and the principle mechanical elements of a lithographic printing couple according to the one preferred embodiment of this invention.

In order to more clearly understand the nature of the present invention, reference is now made to FIGS. 1 through 6 of the drawings where common reference numerals relate to common parts of the overall apparatus. In the Figures, a paper web 10 is printed by means of ink transfer from a conventional rubber blanket cylinder 11, in turn from a conventional printing plate cylinder 12, and conventional rubber covered form rollers 13. An ink and water mixture is controllably metered to the form rollers 13 and thereby to the printing plate mounted on printing plate cylinder 12 where the ink and the dampening water mixture substantially separate from each other to thereby lithographically supply ink only to the image areas of the printing plate, the mixture having been supplied by means of a special wear resistant oleophilic and hydrophobic celled metering roller 14 operating in conjunction with a coextensive metering or doctor blade 15 which blade is affixed at reverse angle to the direction of rotation of metering roller 14 to scrape or meter off all of the ink and water mixture on the metering roller excepting that ink contained in the metering roller cells. An excess of ink and water mixture is fed to the metering roller by a slower turning rubber pan roller 16 which runs in pressure-indented relation with metering roller 14 to assure filling of the metering roller cells with fresh ink and water mixture.

Still referring to FIG. 1 of the drawings, the system of this invention for preparing and supplying a combined ink and water mixture for printing comprises for instance ink supply means or reservoir 20 which has an opening 21 at the top for receiving a quantity of ink and water mixture and an outlet opening 22 which is located below the inlet opening 21 to enable removal of the ink and water mixture from reservoir means 20. Connected to the bottom or outlet opening 22 is pump means 25 which draws the ink and water mixture from the pan and forwards it into mixing means 26. Mixing means 26 is connected to separate sources of replacement dampening water and replacement ink 30 and 31 respectively, whereby fresh materials can be mixed with the already present water and ink mixture that is being conveyed to the mixing means 26 by the pump means 25. It should be noted, that the pump means 25 need not be positioned in the circuit as illustrated in FIG. 1 but can be anywhere in the loop that is defined, it being necessary only that the pump can cause an ink and water mixture to circulate from the reservoir means 20 into the mixer and through the remainder of the closed loop illustrated in FIG. 1. The purpose of mixing means 26 is to take the already existing mixture coming from reservoir means 20 and comingle it with fresh amounts of water and ink, as required to replenish the amounts of each liquid being used up in the printing process, from the inlet means 30 and 31 and thereby assure that a thoroughly mixed constant composition of materials is continuously prepared. From mixer 26 the ink and water mixture flows into a water sensor 35, the purpose of which is to determine whether the amount of water present in the mixture coming from mixer means 26 is sufficient for the printing operation. Water sensing means 35 produces an electrical signal which can be utilized either by having the signal go to an operator so that the operator may take action or preferably it can be used to actuate devices that take appropriate action without operator input. The water sensor is a monitor device that continuously measures water content of the ink in the circulation system for instance in the manner like the capacitive device disclosed by Goldberg et al in U.S. Pat. No. 4,559,493.

After the mixture leaves water sensing means 35, it is forwarded onto means 36 for introducing the ink and water mixture into the top opening 21 of ink reservoir 20. The introducing means 36 is disposed completely across the width of the pan roller 16 to assure that a quantity of ink and water mixture having a uniform and proper ink to water relationship is present throughout the entire width of the inking apparatus. In order to improve the flow of the ink and water mixture into operative relationship with respect to the pan roller 16, the ink supply means 20 illustrated in FIG. 1 normally will have a tray portion 37 spaced below the pan roller and the tray portion will have a generally arcuate shape that conforms to the shape of the pan roller. This configuration assures a continuous and adequate supply of the ink and water mixture to the pan roller and produces a pumping like action that delivers the mixture into the nip between pan roller 16 and the metering roller 14.

Figure 2:
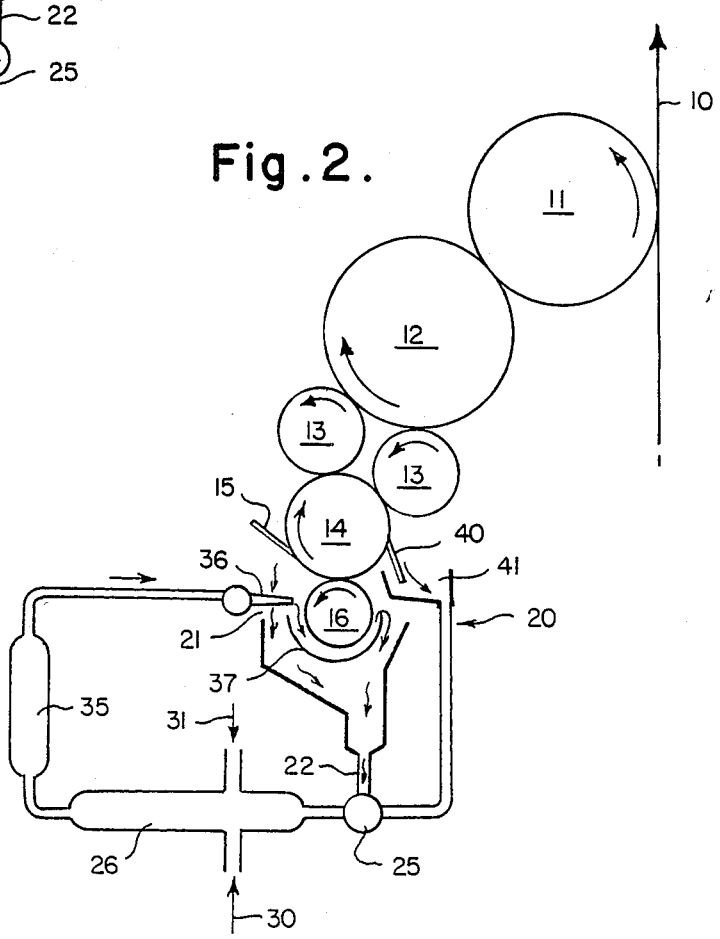
FIG. 2 is a schematic similar to that of FIG. 1 showing a modified inking system and FIGS. 3, 4, 5 and 6 are schematics illustrating further modifications of an inking system according to this invention.

A modification of the ink and water mixture preparing and supplying system shown in FIG. 1 is illustrated in FIG. 2 where common reference numerals indicate parts that are in common with the device of FIG. 1. In FIG. 2 it can be seen that there is provided a second scraping blade 40 which removes the ink and water mixture that is normally and naturally transferred back to the celled metering roller 14 after it has passed the form rollers 13. This removed material instead of being returned to the reservoir means 20 may conveniently be returned to a separate sump portion 41 for return to the pump means 25 where it is admixed with material from pan means 20 and forwarded into the mixing means 26.

Figure 3:
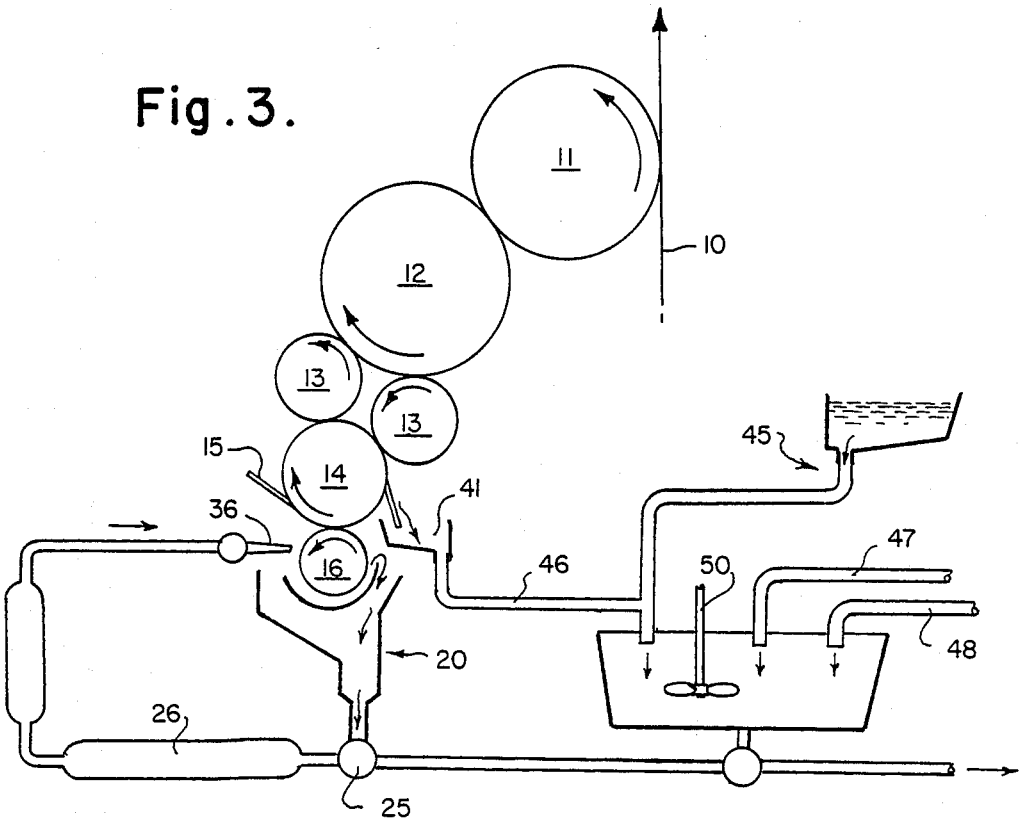

In yet another configuration, specifically that of FIG. 3 of the drawings, the sump portion 41 rather than being connected directly to the pump means 25 is conveyed into a central reservoir means which is indicated generally by the numeral 45. In this configuration, the percentages of water and ink in the mixture are adjusted in the reservoir means 45 rather than in the mixing means 26. Specifically the material which is scraped from the roll by blade 40 is returned to the reservoir 45 by means of conduit 46. Replacement quantities of ink can be supplied by means of conduit 47 and replacement of dampening water by means of conduit 48. Mixing of all the various materials being added to reservoir 46 can be accomplished by means of the rotary stirring member 50. Thereafter, the material will exit, for instance, through the bottom of the reservoir 45 and will flow in one or more directions to the input means of one or more printing couples for entry to the ink supply means that are located at each printing couple.

Figure 4:
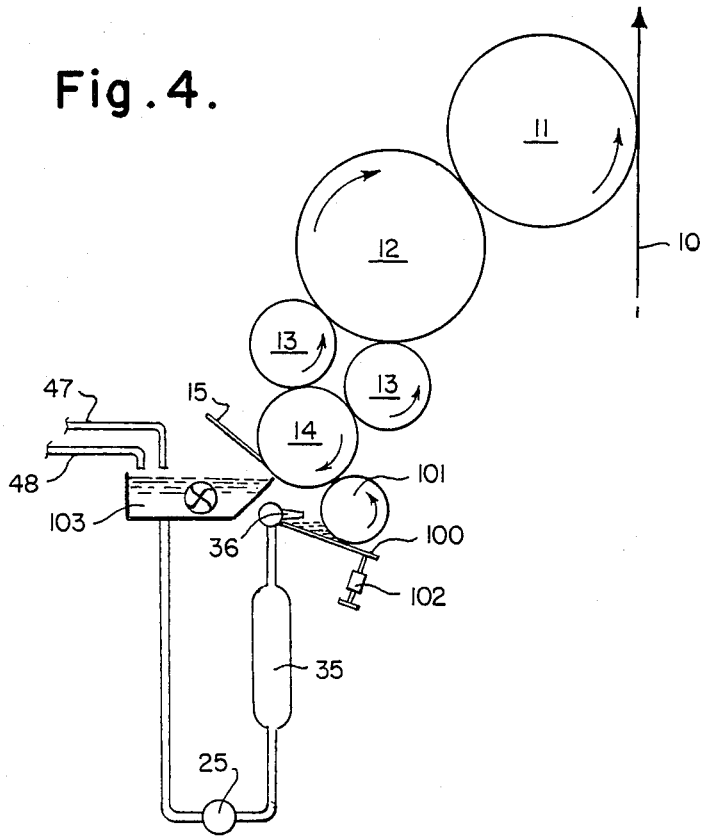
Figure 5:
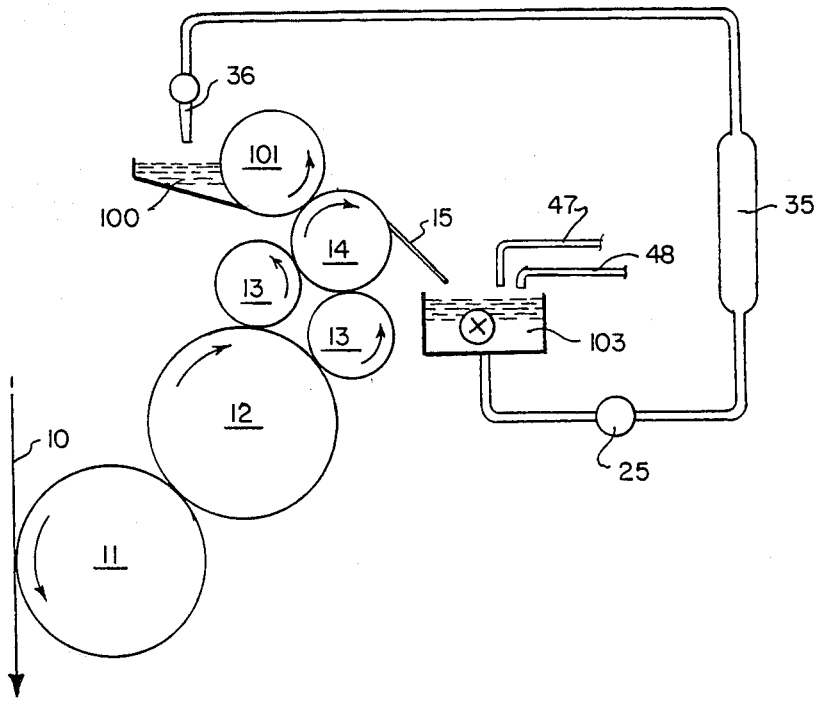

Alternative embodiments using certain of the same elements as FIGS. 1, 2, and 3 are shown in FIGS. 4 and 5, wherein an undershot ink fountain 100 is the ink supply means that replaces the ink supply means 20 of the previous embodiments, and with fountain roller 101 coextensive with and in pressure relation with celled metering roller 14, which together with a conventional gap adjusting mechanism 102 supplies sufficient ink and water mixture to overfill metering roller 14, the excess mixture being then scraped off by doctor blade 15. The scraped ink is led into a separate sump portion 103 where it is admixed with replacement ink from inlet 47 and with replacement dampening water from inlet 48, the resulting admixture then being returned to the ink fountain by means of pump 25 and water sensor 35, both operating substantially as herein previously described to transfer the admixture to the return manifold or outlet ducts 36 that are made coextensive in press width with the fountain roller and with the fountain to assure that the composition of the ink and water mixture in the fountain is maintained continuously at a known constant value.

Figure 6:
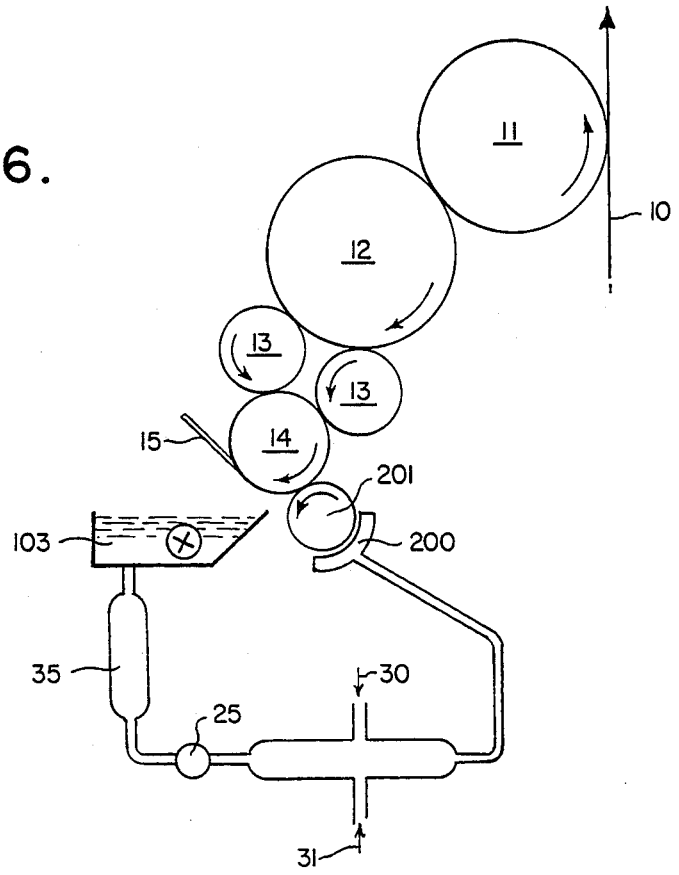

In yet another alternative, FIG. 6, the ink supply fountain of FIGS. 4 and 5, is replaced with a press-wide or one or more page-wide ink fountain rails 200 that feed ink under pressure to slowly rotating receiving roller 201 thereby effecting ink and water input to the metering roller 14 and forming an integral part of the input and circulation system as herein previously disclosed according to the invention.

We have discovered that by replacing the input dry ink normally used in keyless lithography with a water admixture having from about 15% to 50% of dampening water, the keyless inker of for instance FIGS. 1 through 6, can be operated as shown without the necessity for a separate dampening water input system. We believe this is possible because with a keyless inker of the scraped celled metering roller type utilized herein, sufficient water-laden ink is continuously contacting all areas of the printing plate to enable the mixture to supply the amount of dampening water required to maintain all non-image areas free of ink. Since this meets the well-known dampening requirement of lithographic printing, the system prints more or less conventionally excepting that neither inking nor dampening water assisted adjustments by the press operator are required.

During printing according to this invention, the scraped or returned quantities of ink and water mixture contain less water than the input ink and water mixture being conveyed by the inking rollers to the printing plate because a larger portion of the water has been used up or released from the ink and water mixture to keep the non-image areas of the plate supplied with water and because of evaporative losses. If we merely replace the amount of fresh ink being used to form the printed images, the water content of the input ink and water mixture gradually decreases to a value below that necessary to maintain the non-image areas clean. Accordingly, an important feature of this invention is to continuously add make-up dampening water to the ink circulation system, thereby continuously maintaining the water content of the ink and water mixture at or above the required minimum value to assure clean non-image areas on the plate.

It should be apparent to those skilled in the art of lithography that various other roller and press configurational alternatives can be made without departing from the inherent elements of this invention. Examples are one form roller instead of two, three or more form rollers, additional rollers in the inking train of rollers, various combinations of the FIGS. 1 through 6 disclosures and the like.

Having now described the means by which the objects of the invention are obtained, we claim:

1. In a system for the continuous and automatic supply of printing fluid comprised substantially of lithographic ink with lithographic dampening water admixed therein, to a lithographic printing plate mounted on the plate cylinder of a printing press the combination comprising:

(a) printing fluid fountain means;

(b) a fluid metering roller having an oleophilic and hydrophobic surface mounted coextensively with said fluid fountain means to receive printing fluid therefrom;

(c) separate sources of ink and water;

(d) mixing means separate from said printing fluid fountain means to receive ink and water from said separate sources of ink and water and blend them into a substantially uniform dispersion;

(e) ink removal means mounted in cooperative contact with the surface of said fluid metering roller to remove excess printing fluid therefrom;

(f) reservoir means positioned beneath said printing fluid fountain means and beneath said ink removal means to receive those printing fluids from said fluid fountain means and said ink removal means that are not transferred to the plate cylinder;

(g) circulating means including pump means interconnecting said reservoir means, said mixing means and said fountain means so that printing fluid from said reservoir means can be reconstituted to a preselected ink to water ratio and circulated to said fountain means;

(h) printing fluid sampling and signaling means operably connected to said circulating means at a location downstream from said mixing means to produce a signal determinative of the ink to water ratio of the printing fluid; and (i) means responsive to the signal from said printing fluid sampling and signaling means to cause those quantities of ink and water to be introduced into said mixing means with the printing fluid from said reservoir that are required to achieve the ink to water ratio desired for printing operations.

2. The system as defined in claim 1 wherein said ink fountain means includes a tray portion spaced below said fountain roller, said tray portion being located within said reservoir means and having a generally arcuate shape that conforms to the shape of said fountain roller.

3. The system as defined in claim 1 wherein said ink fountain means comprises an undershot ink fountain which is disposed beneath said fountain roller to provide ink and dampening water mixture thereto.

4. The system as defined in claim 1 wherein said ink fountain means comprises an ink fountain rail that delivers the ink and dampening water mixture under pressure to said fountain roller.

5. The system as defined in claim 1 wherein a second scraping blade is mounted for contact with said celled metering roller at a location past that where said celled metering roller has contacted said form rollers and wherein said reservoir means includes a separate sump portion to receive the material removed from said celled metering roller by said second scraper means.

6. The system as defined as claim 5 wherein said separate sump portion is operably connected to said pumping means.

* * * * *